United States Patent [19]

Saito et al.

[11] 3,946,266

[45] Mar. 23, 1976

[54] ELECTROSTATIC AND DYNAMIC MAGNETIC CONTROL OF CATHODE RAY FOR DISTORTION COMPENSATION

[75] Inventors: Tsunenari Saito, Mitaka; Yoshio Aoki, Tokyo, both of Japan

[73] Assignee: Sony Corporation, Tokyo, Japan

[22] Filed: June 17, 1975

[21] Appl. No.: 587,696

Related U.S. Application Data

[63] Continuation of Ser. No. 476,152, June 3, 1974, abandoned.

[30] Foreign Application Priority Data

June 11, 1973 Japan ..... 48-65662

[52] U.S. Cl. ..... 313/442; 313/449; 313/412; 313/413; 313/458

[51] Int. Cl.[2] H01J 29/56; H01J 29/51; H01J 31/20

[58] Field of Search ..... 313/411, 412, 413, 414, 313/428, 441, 442, 448, 458, 460, 453

[56] References Cited

UNITED STATES PATENTS

| | | | |
|---|---|---|---|
| 3,325,675 | 6/1967 | Sanford | 315/13 |
| 3,678,316 | 7/1972 | Barten | 313/412 |
| 3,800,176 | 3/1974 | Gross et al. | 313/403 |
| 3,866,081 | 2/1975 | Hasker et al. | 313/449 |

*Primary Examiner*—Robert Segal
*Attorney, Agent, or Firm*—Lewis H. Eslinger; Alvin Sinderbrand

[57] ABSTRACT

A cathode ray tube is disclosed in which an electron beam is deflected to scan a phosphor screen for producing a picture thereon, and which has an electrostatic beam control device for deforming the cross section of the beam so as to compensate for the distortion in shape of the beam landing spot on the screen at its peripheral portion caused by the beam deflection and a magnetic beam control device for deforming the cross-section of the beam dynamically in response to the beam deflection so as to compensate for the distortion in shape of the beam landing spot on the screen at its central portion caused by the electrostatic beam control device.

9 Claims, 12 Drawing Figures

ELECTROSTATIC AND DYNAMIC MAGNETIC CONTROL OF CATHODE RAY FOR DISTORTION COMPENSATION

This is a continuation of application Ser. No. 476,152, filed June 3, 1974 now abandoned.

BACKGROUND OF THE INVENTION

1. Field of the Invention

This invention relates generally to a cathode ray tube for reproducing a picture on a phosphor screen, and more particularly to an improved cathode ray tube in which a landing spot of an electron beam on a screen is compensated for in distortion of its shape caused by the deflection of the beam.

2. Description of the Prior Art

It has been known that in a cathode ray tube, especially, of the type of wide beam deflection angle, an electron beam is given a deformed cross section by a deflection magnetic field through which the electron beam passes toward a phosphor screen and thereby the beam landing spot on the screen at its some areas is so distorted as to include a portion having an increased current density and as a result, the phosphor at such a portion of the beam landing spot having increased current density is brought in the luminosity-saturated condition to introduce an undesirable picture without high fidelity. By this distortion due to the magnetic deflection field, the beam landing spot at the peripheral portion of the screen is formed in a long sideways oval shape, while the beam spot at the central portion of the screen is formed in a desired circle shape.

For compensating for such a distortion in shape of the beam landing spot, there have been proposed some ways. For example, a magnetic four-pole device is provide on the neck portion of the cathode ray tube for forming the cross section of the beam into a proper shape with a magnetic field produced by a current flowing through the device in synchronism with the deflection current or an electrostatic four-pole device is provided at a focus electrode of an electron gun assembly in the tube for forming the cross section of the beam into the proper shape at the peripheral portions of the screen with an electric field produced at the device. However, these conventional ways require relatively much power consumption and accordingly there is a difficulty for them to be actually employed in commercial models.

SUMMARY OF THE INVENTION

It is an object of the present invention to provide a cathode ray tube in which the distortion in shape of the beam landing spot on a screen caused by the beam deflection is compensated for by an improved system.

Another object of the present invention is to provide a cathode ray tube with an improved system for compensating for the distortion in shape of the beam landing spot on a screen caused by the beam deflection with low power consumption.

A further object of the present invention is to provide a cathode ray tube which is provided with a combination of electro-static means and magnetic means for compensating for the distortion in shape of the beam landing spot on a screen caused by the beam deflection.

The other objects, features and advantages of the present invention will become apparent from the following description taken in conjunction with the accompanying drawings.

DESCRIPTION OF THE PREFERRED EMBODIMENTS

In the cathode ray tube according to the present invention, an electrostatic device or means forming a control electric field and a magnetic device or means forming an additional magnetic field are provided in a electron gun assembly and at the neck portion of the cathode ray tube, respectively, for controlling the shape of cross section of an electron beam so as to compensate for the distortion of the beam landing spot on the screen of the cathode ray tube.

Figure 1:
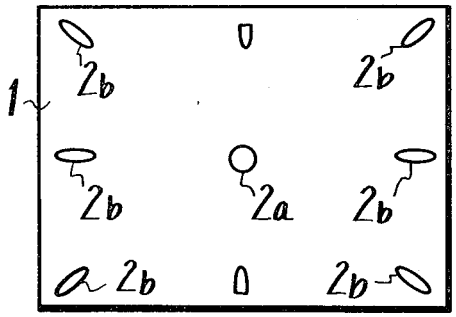
FIGS. 1 to 3 are schematic illustration each showing a pattern of beam landing spots on the screen of a cathode ray tube, which are used for explanation of the present invention.
Figure 2:
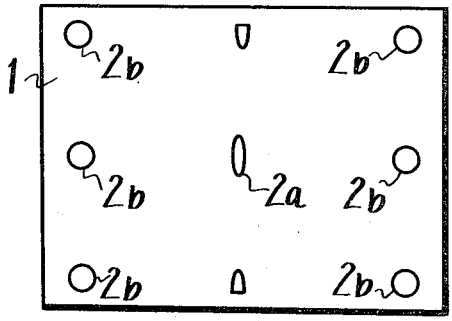
Figure 3:
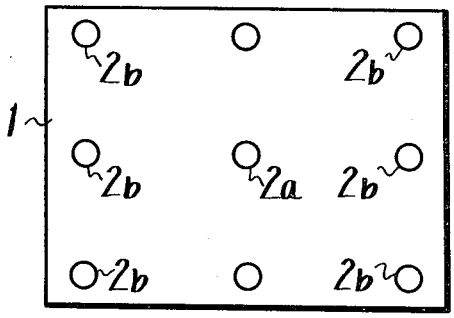

When no compensation device or means is provided, the beam landing spot on a phosphor screen 1 is distorted at the peripheral portion thereof due to the beam deflection as shown in FIG. 1 at **2*b*. In the present invention, to compensate for this distortion of the beam landing spot caused by the beam deflection, the electron beam is previously deformed in its cross section by the control electric field before coming into the deflection field, so that the cross section of the beam after passing through the deflection field is reformed into a suitable shape for producing a circular beam landing spot on the screen 1 at its peripheral portion as shown in FIG. 2 at 2*b*. However, due to this previous deforming of the beam in cross section, the beam landing spot on the screen 1 at its central portion is distorted into an oval shape as shown in FIG. 2 at 2*a*. Accordingly, in the present invention to compensate for this secondary distortion, the beam going towards the central portion of the screen 1 is further previously deformed in its cross section by an additional magnetic field separate from the electrostatic field so as to produce the circular beam landing spot on the screen 1 at its central portion and, as a result, the beam landing spots on the screen 1 at its whole area are shaped into desirable circles, as shown in FIG. 3 at 2*a* and 2*b***.

An embodiment of the present invention will be now described with reference to FIGS. 4 to 9. The illustrated embodiment of the present invention is applied to a color cathode ray tube with a single electron gun assembly of the plural beam type in which a plurality of electron beams are crossed at the optical center of a common main electron lens and the electron beams after passing through the optical center and once diverging outwardly are converged on the phosphor screen by a set of convergence deflectors.

Figure 4:
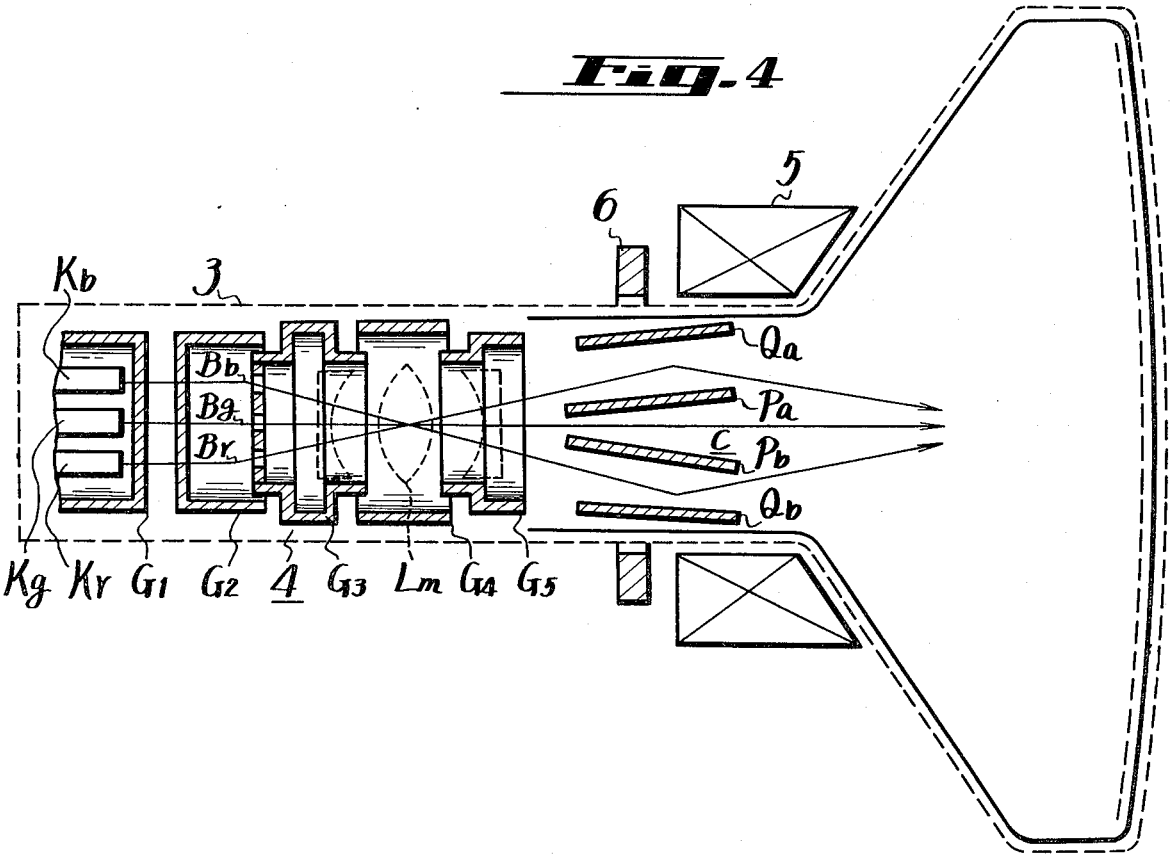
FIG. 4 is a schematic cross-sectional view of one embodiment of the cathode ray tubes in accordance with the present invention.

FIG. 4 shows the main portion of a color cathode ray tube to which the present invention is applied. In the figure, reference numeral 3 designates a glass envelope of the color cathode ray tube, 4 a single electron gun assembly of the plural beam type arranged in the neck portion of the glass envelope 3, and 5 a deflection yoke disposed around the glass evelope 3 at its outside. The single electron gun assembly of the plural beam type 4 is formed as a so-called uni-potential type in which a plurality of cathodes $K_r$, $K_2$ and $K_b$, by way of example, are arranged on a common plane in the glass envelope 3; first, second, third, fourth and fifth common grids $G_1$, $G_2$, $G_3$, $G_4$ and $G_5$ are arranged in the glass envelope 3 along a common axis for the plurality of cathodes $K_r$, $K_g$ and $K_b$ in this order, respectively; and a deflector or convergence device C consisting of four deflection plates $P_a$, $P_b$, $Q_a$ and $Q_b$ is disposed in the glass envelope 3 at the post-stage of the fifth grid $G_5$. Electron beams $B_r$, $B_g$ and $B_b$ emitted from the respective cathodes $K_r$, $K_g$ and $K_b$ passing through corresponding apertures bored through the first and second grids $G_1$ and $G_2$ are crossed at the optical center of a main electron lens $L_m$ formed mainly by the third, fourth and fifth grids $G_3$, $G_4$ and $G_5$, thereafter introduced into the spaces between the deflection plates $Q_a$ and $P_a$; $P_a$ and $P_b$; and $P_b$ and $Q_b$, respectively, and subjected to predetermined deflections, and converged on a striped color phosphor screen.

Figure 5A:
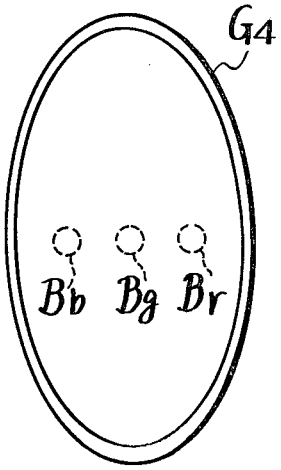
FIGS. 5A, 5B, 6A, 6B, 7A and 7B, inclusive, are schematic illustrations each showing an embodiment of the part of the cathode ray tube in accordance with the present invention.
Figure 5B:
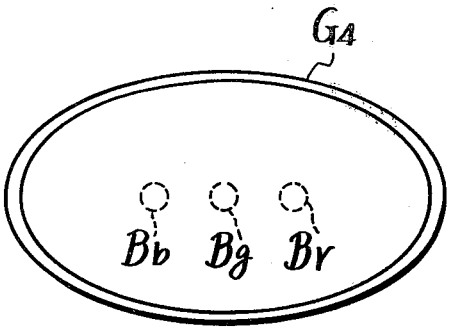
Figure 9:
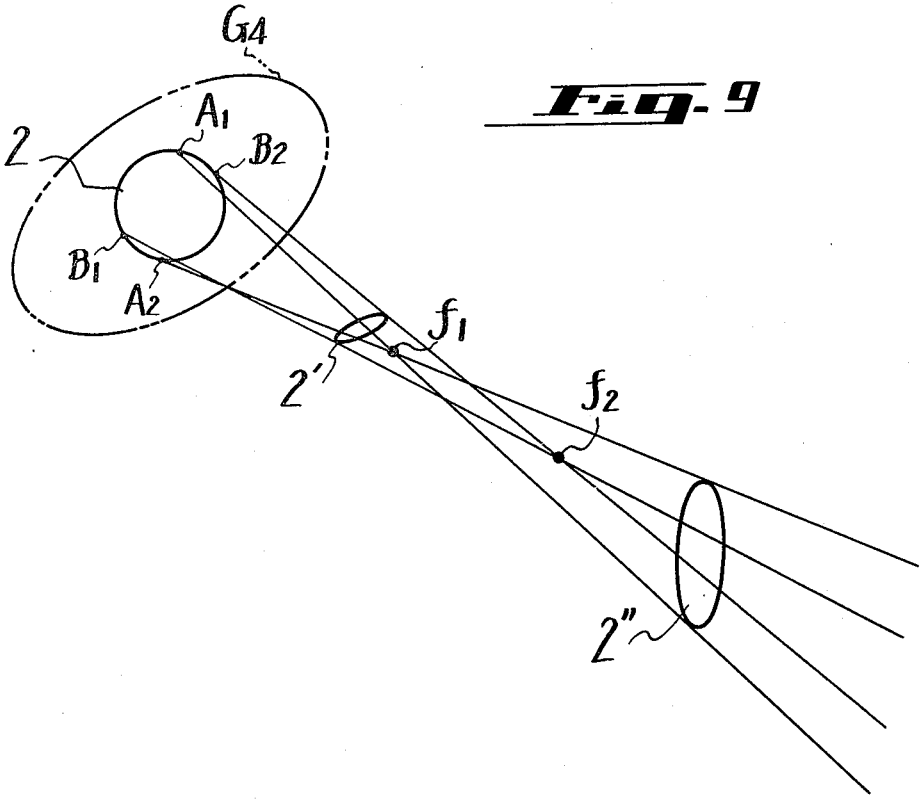
FIG. 9 is a schematic illustration showing the deforming of the cross-section of an electron beam in the cathode ray tube in accordance with the present invention.

With the present invention, an electrostatic compensating device or means, which may originate a control electric field, is provided in connection with the electron gun assembly 4 for compensating for the shapes of beam landing spots on the screen at its peripheral portion to be suitable shapes or circles, and a magnetic compensating device of means 6, which may originate a control magnetic field, is provided externally of and around the neck portion of the glass envelope 3 for compensating for the shapes of beam landing spots on the screen at its central portion, which electron beam may be subjected to distortion caused by the control electric field, to be proper shapes or circles. The control electric field acts to previously deform the electron beams before the deflection field such that their cross sectional shapes are deformed to be a longitudinally elongated oval. The beams with a longitudinally elongated oval-shape in cross section pass through the deflection field and are compensated for to have suitable shape or circle in cross section on the screen at its peripheral portion which may be, otherwise, deformed to be laterally elongated ovals due to the beam deflection. The control electric field can be established by, for example, such a manner that the focus electrode or the fourth grid $G_4$ of the electron gun assembly 4 is formed to be a cup-shape or cylinder which has the cross section of a longitudinally elongated oval as shown in FIG. 5A, or a laterally elongated oval as shown in FIG. 5B. When the cross section of the cup-shaped fourth grid $G_4$ is selected to be the longitudinally elongated oval as shown in FIG. 5A, the beam focus condition is made as an under focus while when the cross section of the cup-shaped fourth grid $G_4$ is selected to be the laterally elongated oval as shown in FIG. 5B, the beam focus condition is made as an over focus. The fourth grid $G_4$ of the uni-potential type forms a convex lens in electrostatic manner, so that if the cross section 2 of the electron beam passing through the fourth grid $G_4$ which is formed of an oval in cross section as shown in FIG. 9 is considered, the electrons on the cross section 2 near points $A_1$ and $A_2$ in the short axis direction of the fourth grid $G_4$ are subjected to strong electric field and hence focussed at a point $f_1$ near the fourth grid $G_4$, while the electrones on the cross section 2 near points $B_1$ and $B_2$ in the long axis direction of the fourth grid $G_4$ are subjected to relatively weak electric field and hence focussed at a point $f_2$ apart from the point $f_1$ with respect to the fourth grid $G_4$. As a result, if the under focus condition is assumed the shape of a cross section 2′ of the electron beam near the fourth grid $G_4$ with respect to both the focuses $f_1$ and $f_2$ becomes to a laterally elongated oval similar to that of the fourth grid $G_4$. On the other hand, if the over focus condition is assumed the shape of a cross section 2″ of the electron beam at a position apart from both the focuses $f_1$ and $f_2$ with respect to the fourth grid $G_4$ becomes to a longitudinally elongated oval intersecting with the fourth grid $G_4$ at substantially right angles. Accordingly, if the fourth grid $G_4$ is formed of a laterally elongated oval and the focus condition for the electron beam is made as an over focus, a beam spot with a longitudinally elongated oval corresponding to the cross section 2″ of the beam shown in FIG. 9 is formed, and if the fourth grid $G_4$ is formed of a longitudinally elongated oval and the focus condition for the electron beam is made as an under focus, a beam spot with the longitudinally elongated oval corresponding to the cross section 2″ of the electron beam as shown in FIG. 9 is also formed. In the both cases, the beam landing spots can be compensated for such that they are circles on the screen 1 at its peripheral portion but a longitudinally elongated oval at the center portion of the screen 1 as shown in FIG. 2.

Figure 6A:
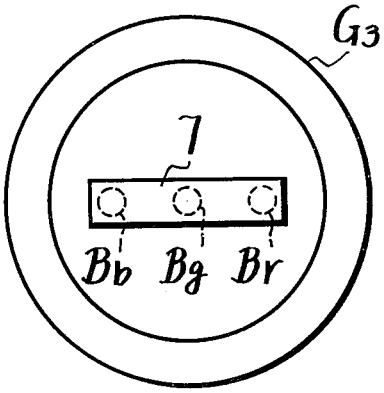
Figure 6B:
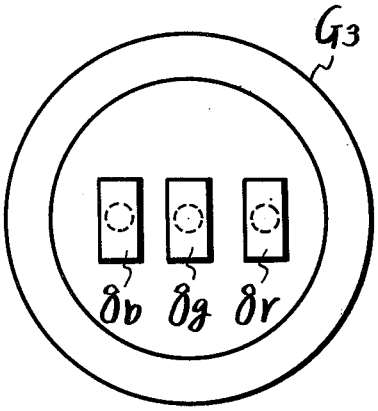

Further, the control electric field can be also established by varying the shape of the third grid $G_3$ or the fifth grid $G_5$ which may form a concave electron lens, respectively. That is, as shown in FIG. 6A, the third grid $G_3$ can be formed in a cup-shape having a closed end face on the side near the second grid $G_2$ and a common laterally elongated common slit 7 is bored through the closed end face at the position corresponding to the part through which the respective electron beams $B_r$, $B_g$ and $B_b$ may pass or, as shown in FIG. 6B, longitudinally elongated slits $8_b$, $8_g$ and $8_r$ are formed, respectively, through the closed end face of the third grid $G_3$ at the positions corresponding to the parts through which the beams $B_b$, $B_g$ and $B_r$ may pass, respectively. In this case, when the latrally elongated common slit 7 is provided the under focus condition is employed for the electron beam, but when the longitudinally elongated slits $8_r$, $8_g$ and $8_b$ are provided, the over focus condition is employed for the electron beam. Since the third grid $G_3$ produces a concave effect from an electrostatic point of view, the astigmatism caused in this case becomes reverse to that of the convex lens in the case of FIG. 9. As a result, the cross section of the electron beam landing spots becomes to a longitudinally elongated oval in the under focus condition, but a laterally elongated oval in the over focus condition.

Figure 7A:
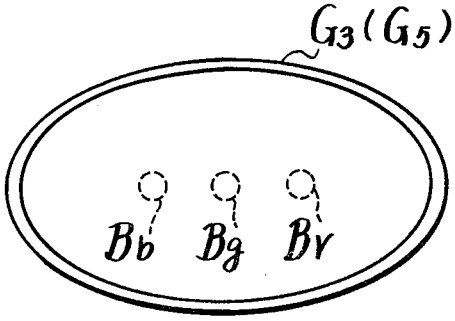
Figure 7B:
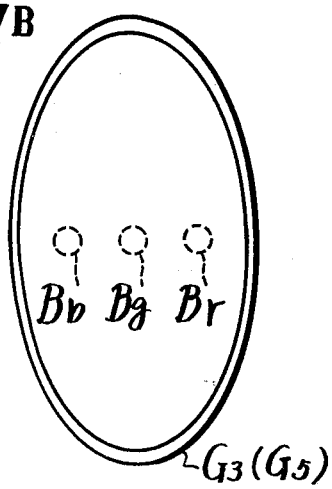

Further, it is also possible that both of the third and fifth grids $G_3$ and $G_5$ may be formed of a cylindrical shape with a laterally elongated cross section as shown in FIG. 7A, or with a longitudinally elongated cross section as shown in FIG. 7B to produce the control electric field. In addition, it is also possible that either of the third and fifth grids $G_3$ and $G_5$ may be formed to have the configuration shown in FIG. 7A or FIG. 7B to provide the control electric field. In the case shown in FIGS. 7A and 7B, when the grid is shaped to have a laterally expanded oval cross section, the under focus condition is employed, while when the grid is shaped to have a longitudinally expanded oval, the over focus condition is employed, as in the case of FIG. 6.

Although not shown, in the case where the beam apertures of the first grid $G_1$ or the second grid $G_2$ are formed oval in cross section, or where the shape of electron beam emitting layers of the cathodes are formed oval, the beam landing spots with a desired longitudinally expanded oval shape can be obtained to achieve the compensation shown in FIG. 2.

Figure 8:
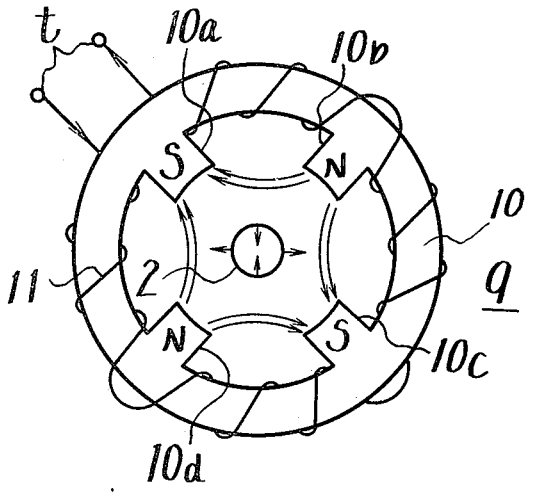
FIG. 8 is a schematic illustration showing one embodiment of a magnetic control device provided in the cathode ray tube in accordance with the present invention.

As a magnetic device or means 6 (refer to FIG. 4) which originates the control magnetic field, a so-called magnetic four-pole device 9, the construction of which is schematically shown in FIG. 8, can be used. The magnetic four-pole device 9 consists of a ring-shaped magnetic core 10, four poles 10*a*, 10*b*, 10*c* and 10*d* inwardly projected from the ring core 10 on which S- and N-poles are arranged alternately, and a correction coil 11 wound on the ring core 10. When a current flowing through the correction coil 11 at its terminals t in the direction shown by arrows in FIG. 8, the cross section 2 of the electron beam is deformed such that it is curved outwardly in an X-axis direction from the center, but inwardly in a Y-axis direction from the center and hence becomes to an oval with its longer axis in the X-axis direction. When a current flows through the coil 11 in the reverse direction the cross section of the electron beam can be made as an oval with its longer axis in the Y-axis direction in cross section. The ratio of the deformation in cross section of the electron beam can be adjusted by controlling the current flowing through the correction coil 11. One or several of such a magnetic four-pole device 9 can be used.

With the present invention, a predetermined parabolic waveform current is caused to flow through the correction coil 11 of the magnetic fourpole device 9 in synchronism with the deflection current from the electron beam to dynamically compensate for the cross section of the beam landing spot on the screen at its central portion, which is deformed as a longitudinally elongated oval due to the astigmatism by the control electric field, to be a proper one.

According to the present invention mentioned as above, by deforming the cross section of electron beam before the deflection by the control electric field, the shape of the beam landing spots on the screen at its peripheral portion is made to be a suitable one or circle; and the electron beam, the cross section of which may be distored on the screen at its central portion by the control electric field, is compensated for by the additional magnetic field, so that the distortion of the beam landing spot caused by the deflection yoke can be compensated for by the device which is small in power consumption as a whole. In other words, the great power consumption is required for compensating for the distortion of the beam landing spot on the screen at its peripheral portion by the magnetic four-pole device 9, but the compensation for the distortion of the beam landing spot on the screen at its central portion only requires small power consumption. Since with the present invention the compensation for the beam landing spot by the magnetic device is limited only to the central portion of the screen, power consumption thereby is very small.

In the illustrated embodiment, the present invention is applied to the color cathode ray tube of the type with the single electron gun of the plural electron beams but it may be apparent that the present invention can be adapted in an ordinary color cathode ray tube.

Although the above description is given on the preferred embodiment of the present invention, it may be evident that many modifications and variations can be made by those skilled in the art without departing from the spirits and scope of the novel concepts of the invention.

We claim as our invention:

1. A cathode ray tube having an envelope provided with a phosphor screen thereon, comprising:
   a. beam generating means for emitting at least one electron beam toward said screen to be deflected at a region between said beam generating means and said screen to scan said screen;
   b. electrostatic beam control means located to affect said beam between said beam generating means and said region and operable on said electron beam for deforming the crosssectional shape of said electron beam to compensate for the distortion in shape of the beam landing spot on said screen at its peripheral portion casued by beam deflection; and
   c. magnetic beam control means located to affect said beam between said beam generating means and said region and operable on said electron beam for further deforming the cross-sectional shape of said electron beam dynamically in synchronism with the beam deflection to compensate for the distortion in shape of the beam landing spot on said screen at its central portion caused by said electrostatic beam control means.

2. A cathode ray tube according to claim 1, wherein said electrostatic beam control means is positioned at the inside of the envelope between said beam generating means and said region, and said magnetic beam control means is positioned at the outside of the envelope between said beam generating means and said region.

3. A cathode ray tube according to the claim 2, wherein said electrostatic beam control means comprises a tubular electrode with an oval cross section supplied with a voltage at a predetermined potential to form an electron lens field for focussing the electron beam.

4. A cathode ray tube according to claim 3, wherein said electrostatic beam control means comprises three electrodes disposed in series with a common axis and said tubular electrode with an oval cross section is the center one of said three electrodes for establishing said electron lens field.

5. A cathode ray tube according to claim 3, wherein said electrostatic beam control means comprises three electrodes disposed in series with a common axis and said tubular electrode with an oval cross section is an end one of said three electrodes for establishing said electron lens field.

6. A cathode ray tube according to claim 2, wherein said electrostatic beam control means comprises a cup-shaped electrode having a rectangular aperture at its bottom through which said electron beam passes and supplied with voltage at a predetermined potential to form an electron lens field for focussing the electron beam.

7. A cathode ray tube according to claim 6, wherein said cup-shaped electrode is an end one of three electrodes disposed in series with a common axis for establishing said electron lens field.

8. A cathode ray tube according to claim 2, wherein said magnetic beam control means comprises a four pole device consisting of a magnetic core and a coil wound on said magnetic core and supplied with a current varying in synchronism with a beam deflection current.

9. A cathode ray tube according to claim 8, wherein said magnetic core is ring-shaped and disposed around a neck portion of the tube.

* * * * *